US009888824B2

(12) United States Patent
Spangberg

(10) Patent No.: US 9,888,824 B2
(45) Date of Patent: Feb. 13, 2018

(54) CLEANING DEVICE

(71) Applicant: Tomas Spangberg, Laguna Niguel, CA (US)

(72) Inventor: Tomas Spangberg, Laguna Niguel, CA (US)

( * ) Notice: Subject to any disclaimer, the term of this patent is extended or adjusted under 35 U.S.C. 154(b) by 779 days.

(21) Appl. No.: 14/209,701

(22) Filed: Mar. 13, 2014

(65) Prior Publication Data

US 2015/0096593 A1 Apr. 9, 2015

Related U.S. Application Data

(60) Provisional application No. 61/785,880, filed on Mar. 14, 2013.

(51) Int. Cl.

| | |
|---|---|
| ***B08B 1/00*** | (2006.01) |
| ***A47L 13/48*** | (2006.01) |
| ***A47L 13/44*** | (2006.01) |
| ***A47L 13/254*** | (2006.01) |
| ***A47L 13/257*** | (2006.01) |
| ***A47L 13/42*** | (2006.01) |

(52) U.S. Cl.

CPC ..... *A47L 13/44* (2013.01); *A47L 13/254* (2013.01); *A47L 13/257* (2013.01); *A47L 13/42* (2013.01); *A47L 13/48* (2013.01)

(58) Field of Classification Search

CPC ..... B08B 1/00; B08B 1/001; B08B 1/002; B08B 1/006; A47L 13/00; A47L 13/02; A47L 13/10; A47L 13/16; A47L 13/20; A47L 13/256; A47L 13/257

See application file for complete search history.

(56) References Cited

U.S. PATENT DOCUMENTS

| | | | | |
|---|---|---|---|---|
| 1,896,946 A | | 2/1933 | Gauss | |
| 2,789,298 A | | 4/1957 | Peterson | |
| 3,359,589 A | * | 12/1967 | Moore | B05C 17/00 15/210.1 |
| 4,059,864 A | * | 11/1977 | Spresny | A47L 1/06 15/105 |
| 4,580,307 A | | 4/1986 | Moss | |
| 4,797,968 A | | 1/1989 | Wenzlick et al. | |
| 4,831,682 A | | 5/1989 | White | |

(Continued)

FOREIGN PATENT DOCUMENTS

DE 842 390 6/1952

OTHER PUBLICATIONS

Jun. 17, 2015 Search Report and Search Opinion for European Application No. 14200743.4 filed on Dec. 31, 2014.

*Primary Examiner* — Saeed T Chaudhry
(74) *Attorney, Agent, or Firm* — Knobbe, Martens, Olson & Bear, LLP

(57) ABSTRACT

A holder for a cleaning pad or the like can include a base and one or more features to inhibit damage to a surface adjacent a surface being cleaned. For example, the holder can include a lip extending downwardly from an edge of the base along one or more sides to inhibit the pad from being coupled to the holder so that the pad extends beyond the edge of the base. The holder can also include one or more contacting features extending outwardly from the base on the side(s) including the lip to space the base and lip from the adjacent surface during use. The contacting features can be one or more wheels horizontally disposed on a top surface of the base.

20 Claims, 14 Drawing Sheets

(56) References Cited

U.S. PATENT DOCUMENTS

| | | | | |
|---|---|---|---|---|
| 5,271,119 | A | 12/1993 | Myers et al. | |
| 5,495,635 | A * | 3/1996 | Williams | B05C 17/0242 15/145 |
| 5,509,171 | A | 4/1996 | Zejda | |
| 5,862,565 | A * | 1/1999 | Lundstedt | B25G 3/38 15/144.1 |
| D482,202 | S * | 11/2003 | Newman | D4/121 |
| 6,813,800 | B2 | 11/2004 | Liccardi | |
| 7,404,227 | B2 | 7/2008 | Otsuka et al. | |
| 7,536,743 | B2 | 5/2009 | Goh et al. | |
| 7,703,168 | B2 | 4/2010 | Bennett | |
| 2007/0130714 | A1 * | 6/2007 | Williams | B05C 17/022 15/230.11 |
| 2008/0086832 | A1 | 4/2008 | Bennett | |
| 2008/0282489 | A1 | 11/2008 | Monahan et al. | |
| 2011/0225763 | A1 | 9/2011 | Drake | |

* cited by examiner

CLEANING DEVICE

CROSS-REFERENCE TO RELATED APPLICATIONS

The present application claims the priority benefit of U.S. Provisional Application No. 61/785,880, filed Mar. 14, 2013, the entirety of which is hereby incorporated by reference herein.

BACKGROUND

Field

The present disclosure relates generally to devices for cleaning surfaces, such as floors, and more specifically to holders configured to receive cleaning or scrubbing pads or the like.

Description of the Related Art

Various types of devices for cleaning surfaces, for example, floors, walls, and/or other such surfaces, are available (see, e.g., FIGS. 1A-1C). In some cases, a cleaning pad of a cleaning device extends outwardly such that it can contact walls, baseboards, and/or other surfaces surrounding the floor area being cleaned. Some cleaning pads have abrasive surfaces and could damage or mar the surrounding surfaces. In some cases, even if the cleaning pad does not extend beyond the base, edges of the base can damage or mar surrounding surfaces.

SUMMARY

The cleaning devices and holders of the present disclosure advantageously allow for the holder to be used adjacent and/or alongside a wall or other surface while minimizing damage to the adjacent surface.

In some embodiments, a cleaning device for cleaning a surface includes a holder that includes a base having a top surface, a bottom surface, and an outer periphery. The top surface is configured to receive at least one handle, and the bottom surface is configured to receive a cleaning pad. The holder also includes a lip extending downwardly from a perimeter of the base along at least one side of the base such that at least a portion of the lip extends below the bottom surface of the base. The lip is at least partially adjacent at least one edge of the cleaning pad when the cleaning pad is received by or attached to the bottom surface of the base so as to prevent the at least one edge of the cleaning pad from extending outwardly beyond the lip. The cleaning device also includes at least one contacting member or feature extending from the base. The at least one contacting member or feature is sized and configured to extend outwardly beyond the periphery of the base.

In some embodiments, the lip extends along two adjacent sides of the base. In some embodiments, the at least one contacting feature includes at least one wheel or other movable member. The cleaning device can include three contacting features positioned along the lip. The bottom surface of the base can be configured to removably receive the cleaning pad. In some embodiments, the lip has a generally smooth and flat surface. In some embodiments, the base has a generally rectangular shape. The top surface of the base can include a coupling for receiving the handle. The cleaning device can include a handle configured for placement within the coupling. In some embodiments, the contacting feature or member is separate from the base and can be removably or permanently attached to the base. In some embodiments, the contacting feature or member is integral with the base.

BRIEF DESCRIPTION OF THE DRAWINGS

These and other features, aspects, and advantages of the present disclosure are described with reference to the drawings of certain embodiments, which are intended to schematically illustrate certain embodiments and not to limit the disclosure.

DETAILED DESCRIPTION

Although certain embodiments and examples are described below, those of skill in the art will appreciate that the disclosure extends beyond the specifically disclosed embodiments and/or uses and obvious modifications and equivalents thereof. Thus, it is intended that the scope of the disclosure herein disclosed should not be limited by any particular embodiments described below.

Figure 1B:
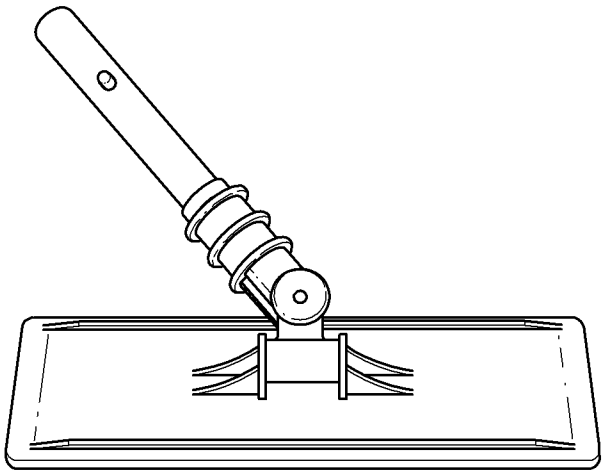
FIGS. 1A-1C show various available cleaning devices.
Figure 1A:
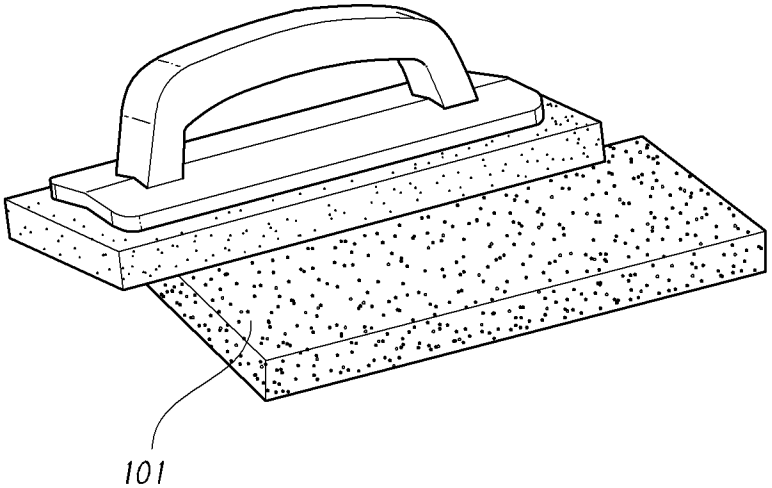
Figure 1C:
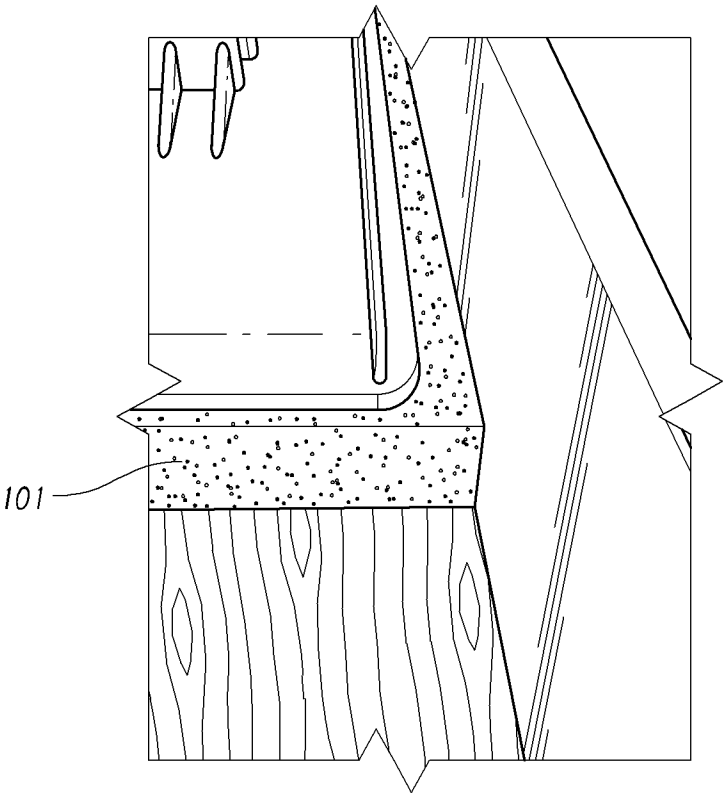
Figure 2:
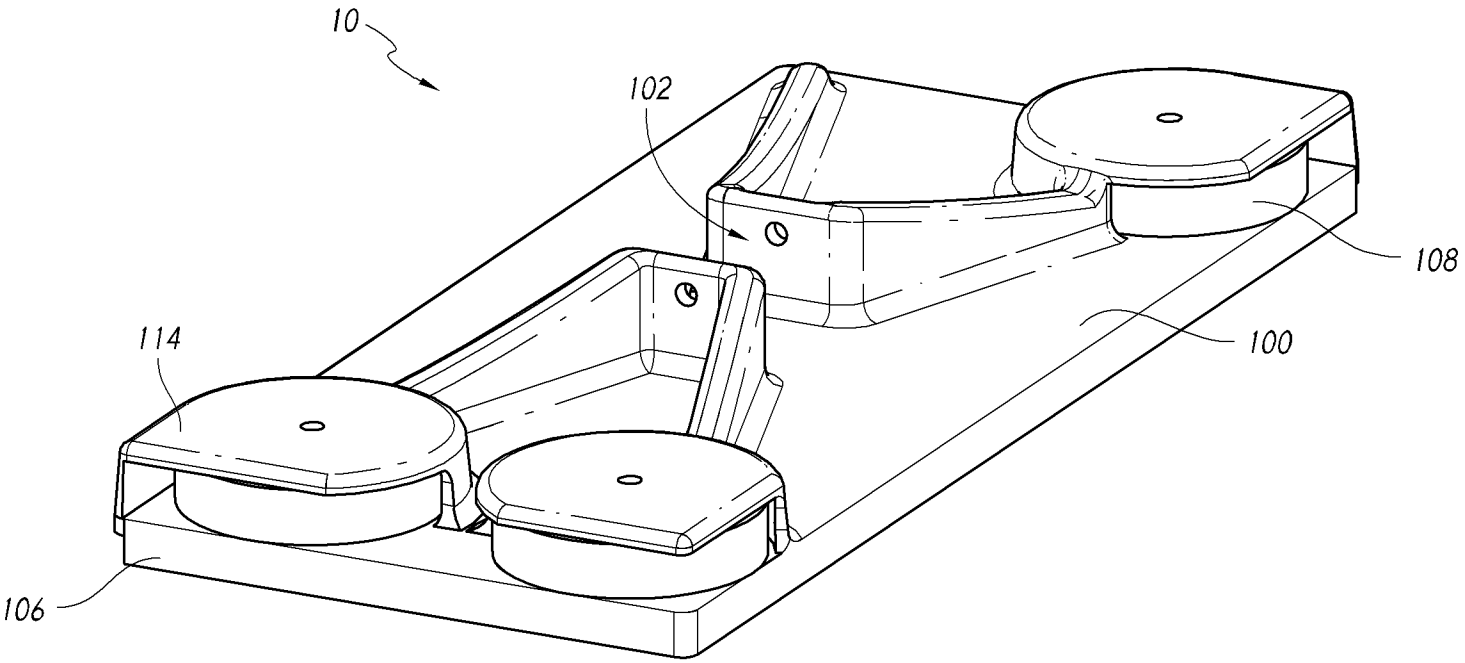
FIG. 2 shows a perspective side view of an example embodiment of a holder.
Figure 3:
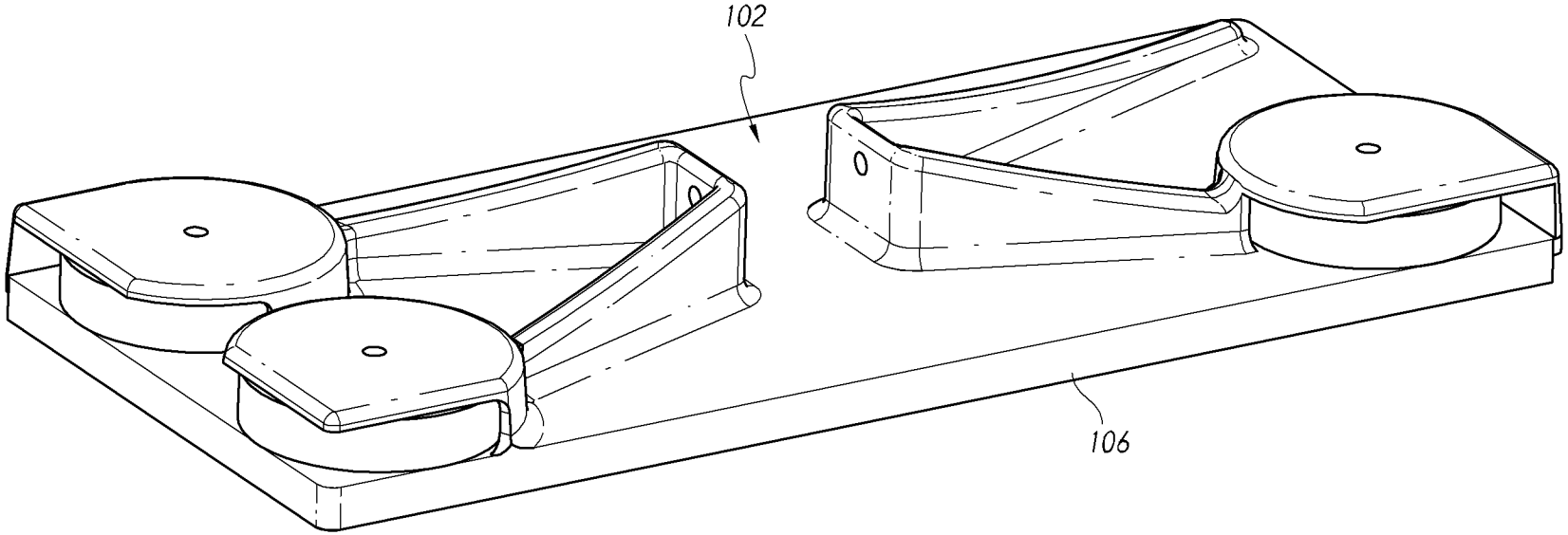
FIG. 3 shows a top perspective view of the holder of FIG. 2.
Figure 4:
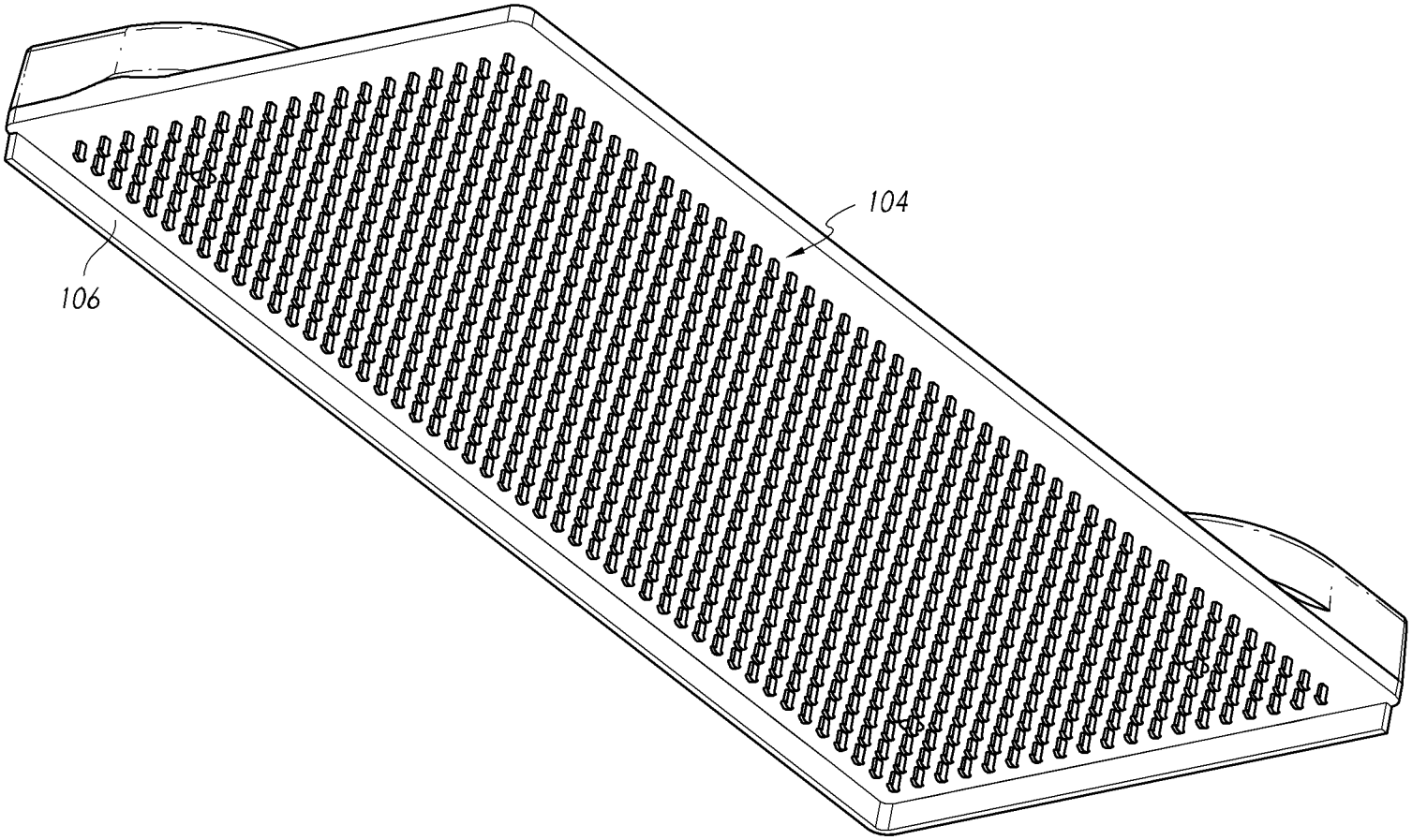
FIG. 4 shows a bottom perspective view of the holder of FIGS. 2 and 3.
Figure 5:
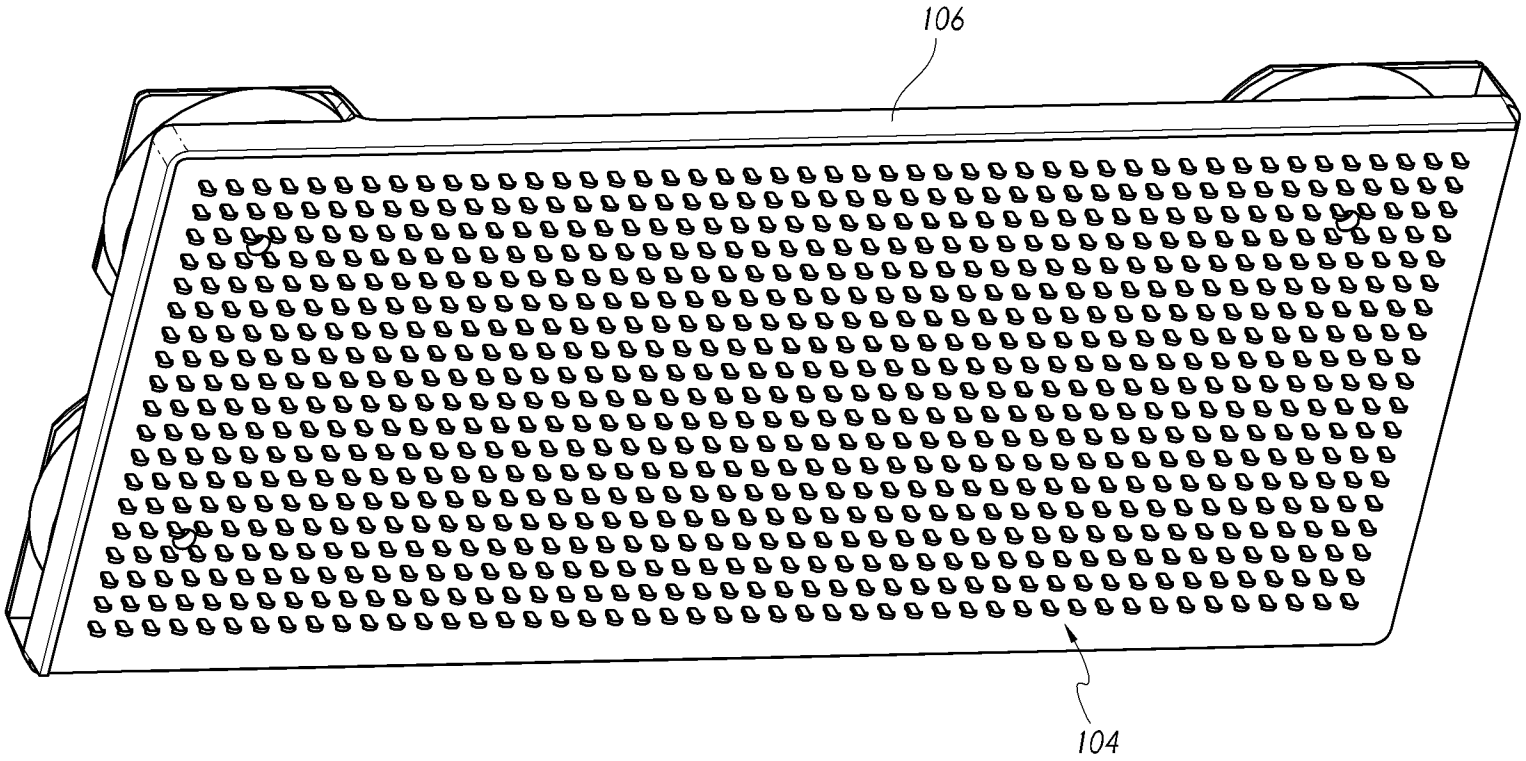
FIG. 5 shows another bottom perspective view of the holder of FIGS. 2-4.
Figure 6:
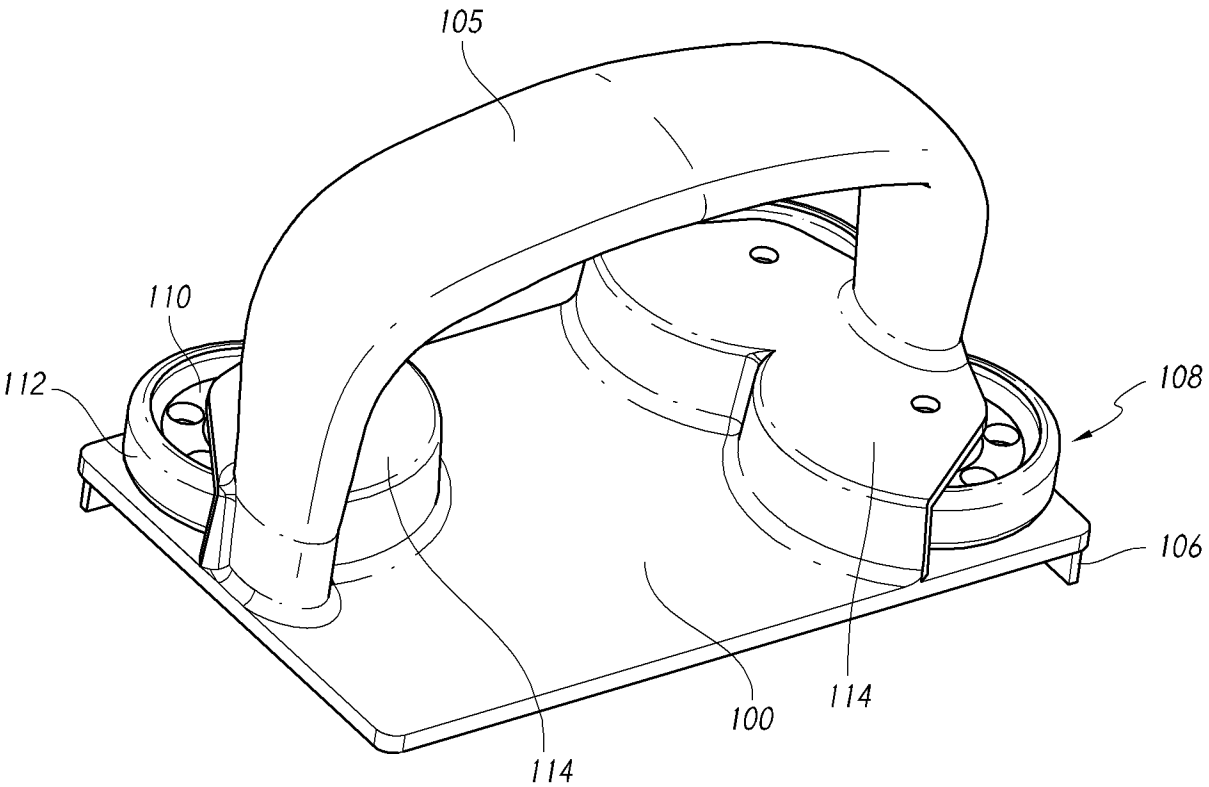
FIG. 6 shows an example embodiment of a small, handheld holder.

A cleaning device or holder 10 according to the present disclosure can generally include a base and one or more contacting features configured to minimize damage to surrounding areas during use. In some embodiments, for example as illustrated in FIGS. 2-5, the base 100 is generally rectangular. As shown in FIGS. 2 and 3, the base 100 can include an attachment area 102 for receiving a long, pole-type handle, such as, for example, the handle 103 shown in FIG. 8B. Alternatively, the base 100 can include a handle 105 configured for handheld use, for example as shown in FIG. 6. The base 100 is configured to receive a cleaning pad, brush, sheet, or the like, for example, such as the example cleaning pads 101 illustrated in FIGS. 1A and 1C. The cleaning pad 101 can be removably or permanently coupled to a bottom surface of the base 100 with, for example, an adhesive, protrusions 104 as shown in FIGS. 4 and 5, and/or any other suitable attachment means. The base 100 can be made of PVC having a Shore D durometer of about 70, although other materials are also possible.

Figure 10:
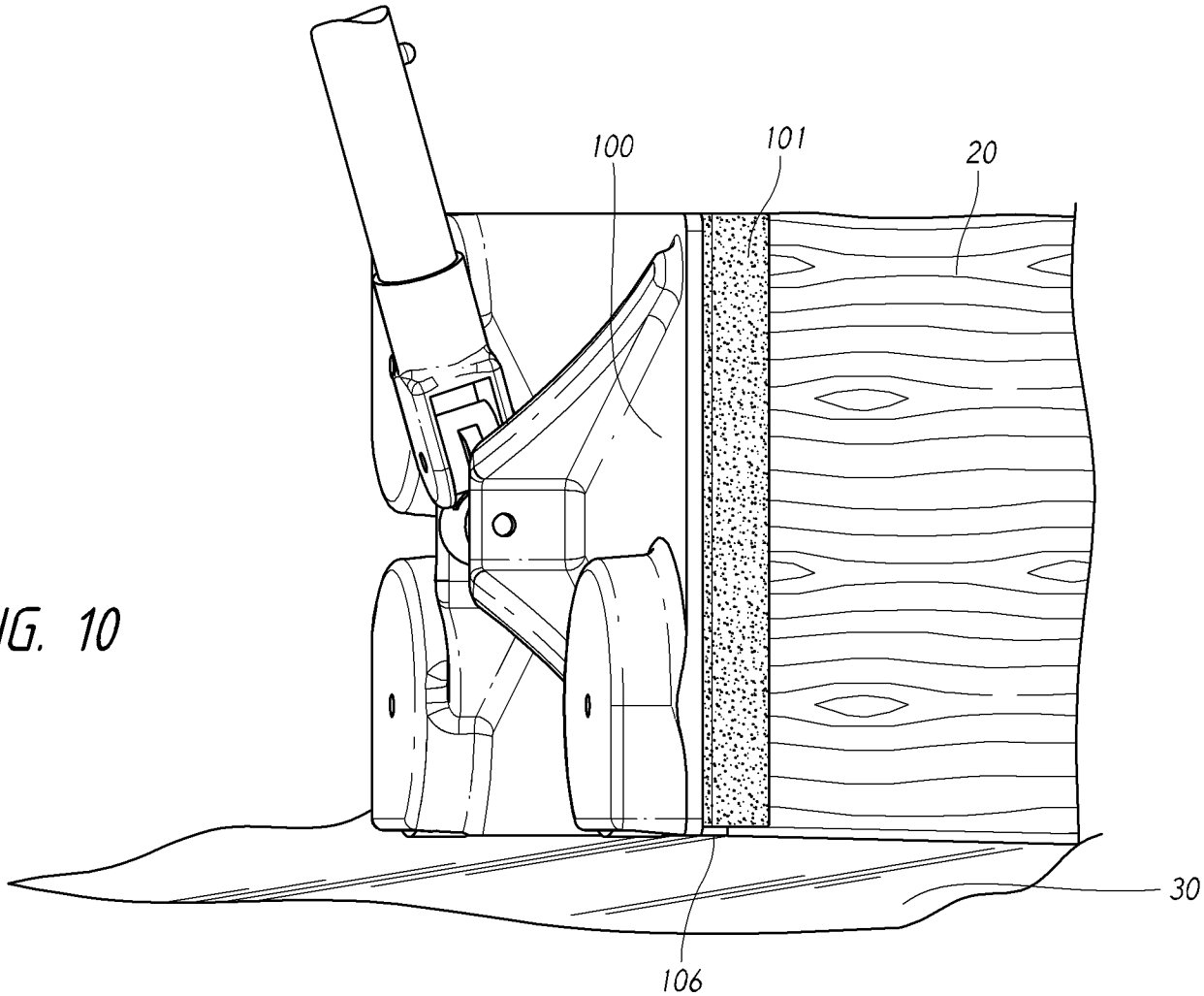
FIG. 10 shows the holder of FIGS. 2-5 being used to clean a floor adjacent a wall.

In some embodiments, the holder 10 includes a lip 106 extending downwardly from a perimeter of the base 100 along at least one side of the base. In the illustrated embodiment, the lip 106 extends along two adjacent sides of the base 100. As shown in FIG. 10, the lip 106 inhibits the cleaning pad 101 from extending outwardly beyond the perimeter of the base 100 so that the lip 106, rather than the side of the cleaning pad 101, may contact a wall 30 or another surface adjacent a floor 20 or other surface being cleaned. Although the holder 10 is generally discussed herein in the context of cleaning a floor surface adjacent a wall, the holder 10 can be used to clean various other surfaces adjacent various surfaces, for example, to clean a wall adjacent a floor, a floor or wall adjacent cabinetry, etc.

The holder 10 can also include at least one contacting feature extending outwardly from the base 100, typically from the side(s) of the base 100 including the lip 106. The contacting feature is configured to space the base 100 from the wall to inhibit or prevent contact between the wall and the pad 101 and/or lip 106. The contacting feature can maintain a certain distance between the wall and base 100 to inhibit damage to the wall while keeping the pad 101 close enough to the wall to avoid leaving an area of uncleaned floor along the wall. In some embodiments, the at least one contacting feature is coupled to a top surface of the base 100. In some embodiments, the holder 10 includes at least two contacting features, each proximate a corner of the base 100 adjacent the side(s) including the lip 106.

Figure 11:
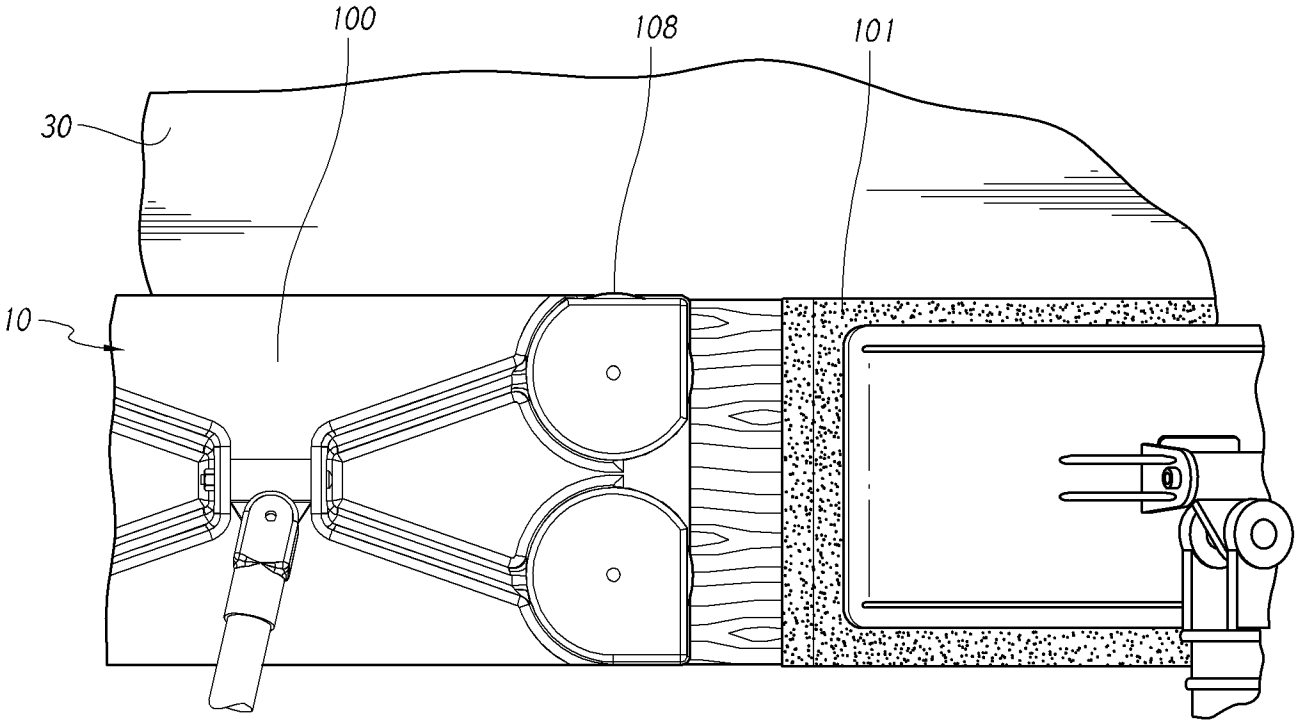
FIG. 11 shows the holder of FIG. 10 compared to a prior art holder being used to clean a floor adjacent a wall.

In some embodiments, for example as shown in FIGS. 2-5, the contacting feature is a wheel 108 disposed horizontally on the top surface of the base 100. The illustrated embodiment includes three wheels 108, each proximate a corner of the base 100 adjacent the sides including the lip 106. As illustrated in FIG. 11, the wheels 108 of the holder 10, shown on the left, space the base 100 and pad 101 from the wall 30, compared to a prior art holder, shown on the right, which allows the pad 101 to directly contact the wall 30. With reference to FIG. 6, the wheels 108 can have a center 110 made of PVC having a Shore D durometer of about 70 and a perimeter or contacting portion 112 made of nitrile rubber having a Shore A durometer of about 30 bonded to the center 110, although other materials are also possible. In some embodiments, the base 100 includes one or more wheel housings 114 for one or more of the wheels 108. The wheel housings 114 can cover a portion of the wheels 108 to help mount the wheels 108 on the base 100 and/or to help protect the wheels 108 from wear and tear.

In use, the wheels 108 can roll along the wall or adjacent surface to allow the user to easily glide the holder 10 along the wall without damaging the wall. However, contacting features other than wheels are also possible. For example, the contacting features can include a non-damaging outer surface or portion that is movable (e.g., slidable) or fixed and has a smooth, cushioned, non-abrasive, or other protective surface.

Figure 7:
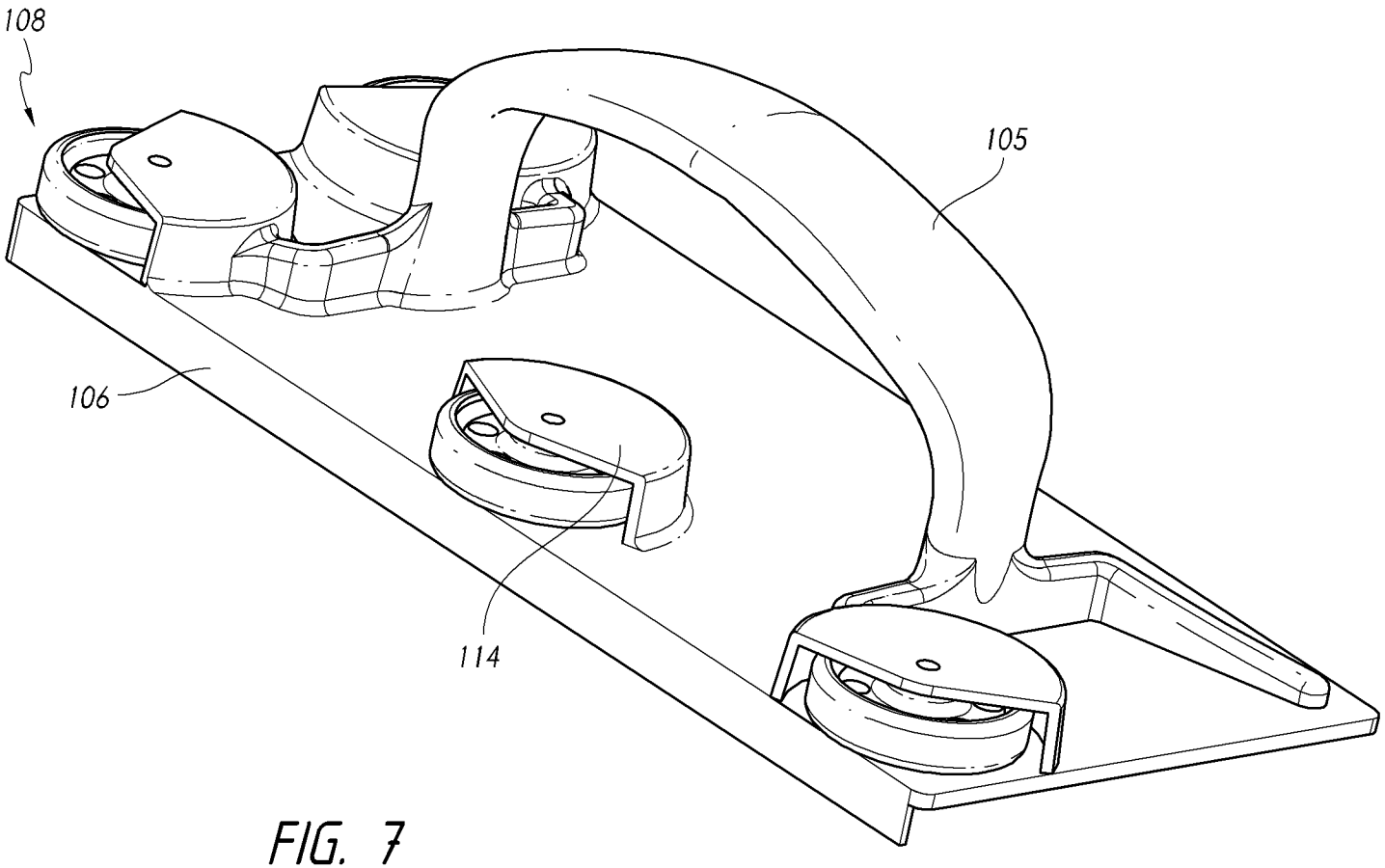
FIG. 7 shows an example embodiment of a large, handheld holder.
Figure 8A:
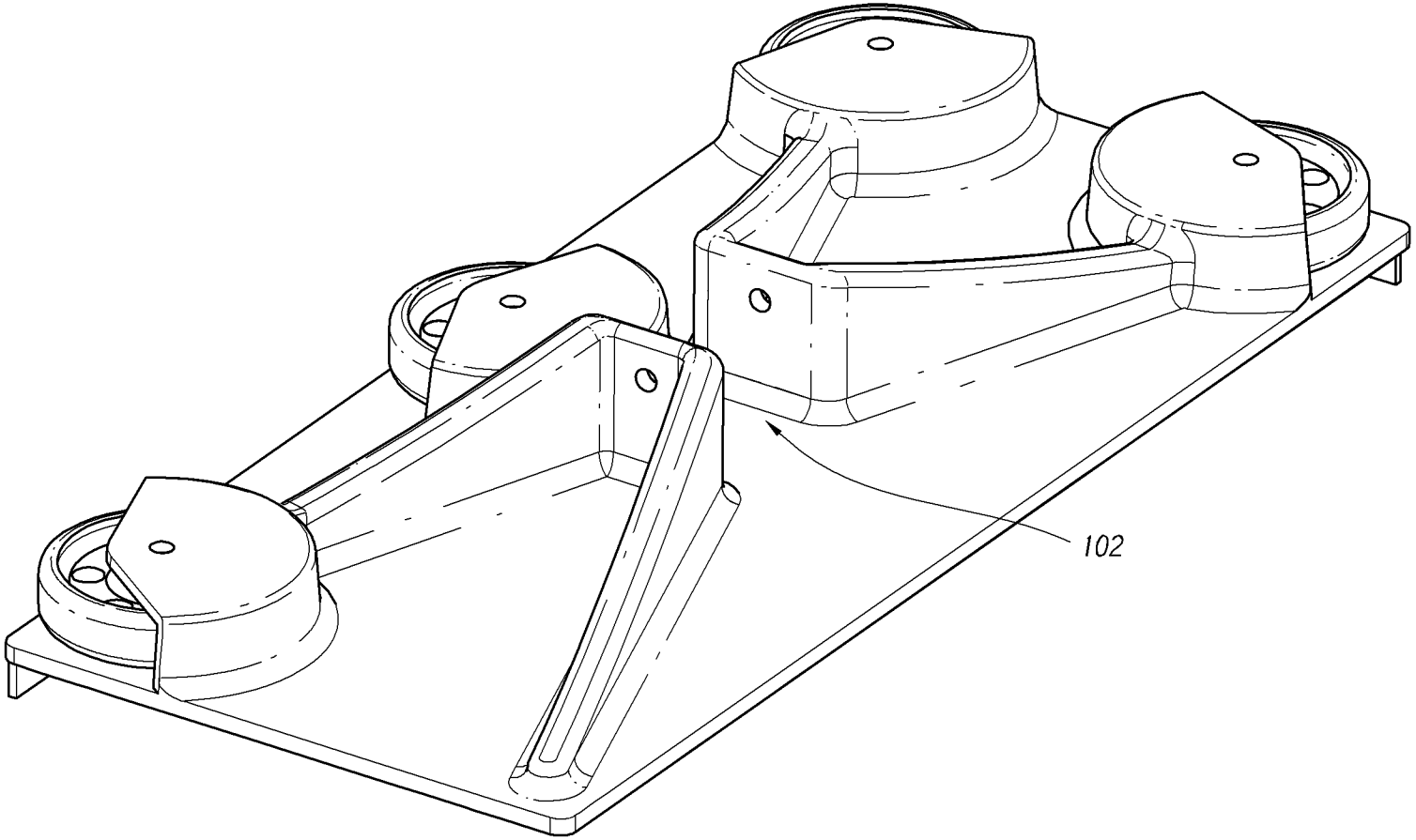
FIG. 8A shows a perspective view of an example embodiment of a large holder for use with a pole-type handle.
Figure 8B:
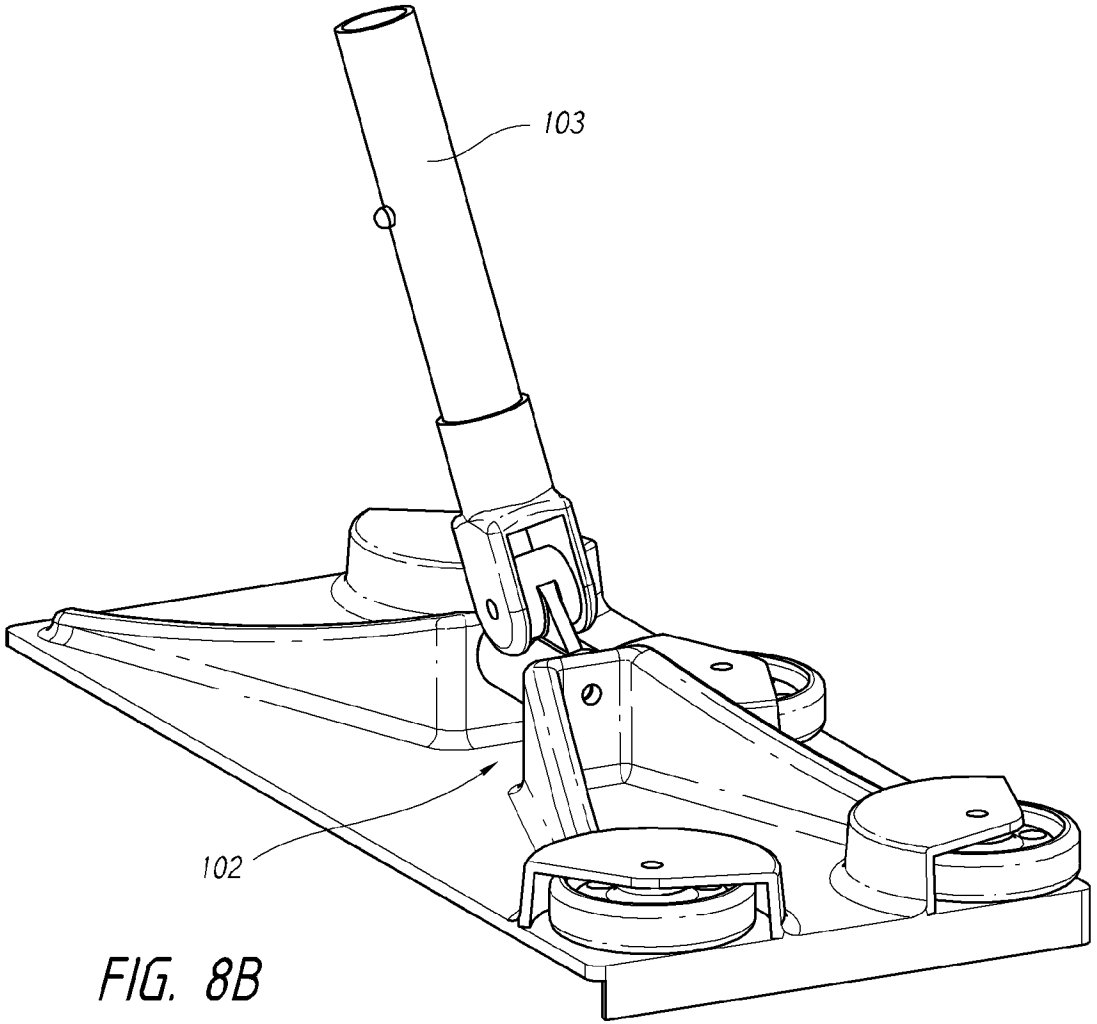
FIG. 8B shows a perspective view of the holder of FIG. 8A including a handle.

The holder 10 can be made in a variety of sizes and configurations. For example, the base 100 of FIG. 6 can be a relatively small size configured to be convenient for handheld use and can have, for example, a length of about 118 mm and a width of about 81 mm. Another example embodiment of the base 100 as shown in FIG. 7 can include a handle 105 configured for handheld use, but can be a larger size than the base 100 of FIG. 6. For example, the base of FIG. 7 can have a length of about 250 mm and a width of about 110 mm. In the illustrated embodiment, the holder includes a third wheel 108 positioned near a center of the longer side of the base including the lip 106 so that the holder includes a total of four wheels. The additional wheel 108 can help maintain the distance between the wall and the lip 106 and/or pad 101 along the longer side of the base 100. The base of FIG. 8A can be a similar size to that of FIG. 7, but can include an attachment area 102 for a long, pole-type handle, for example, as shown in FIG. 8B, rather than a handle 105 for handheld use. Other sizes, configurations, and combinations are also possible.

Figure 9:
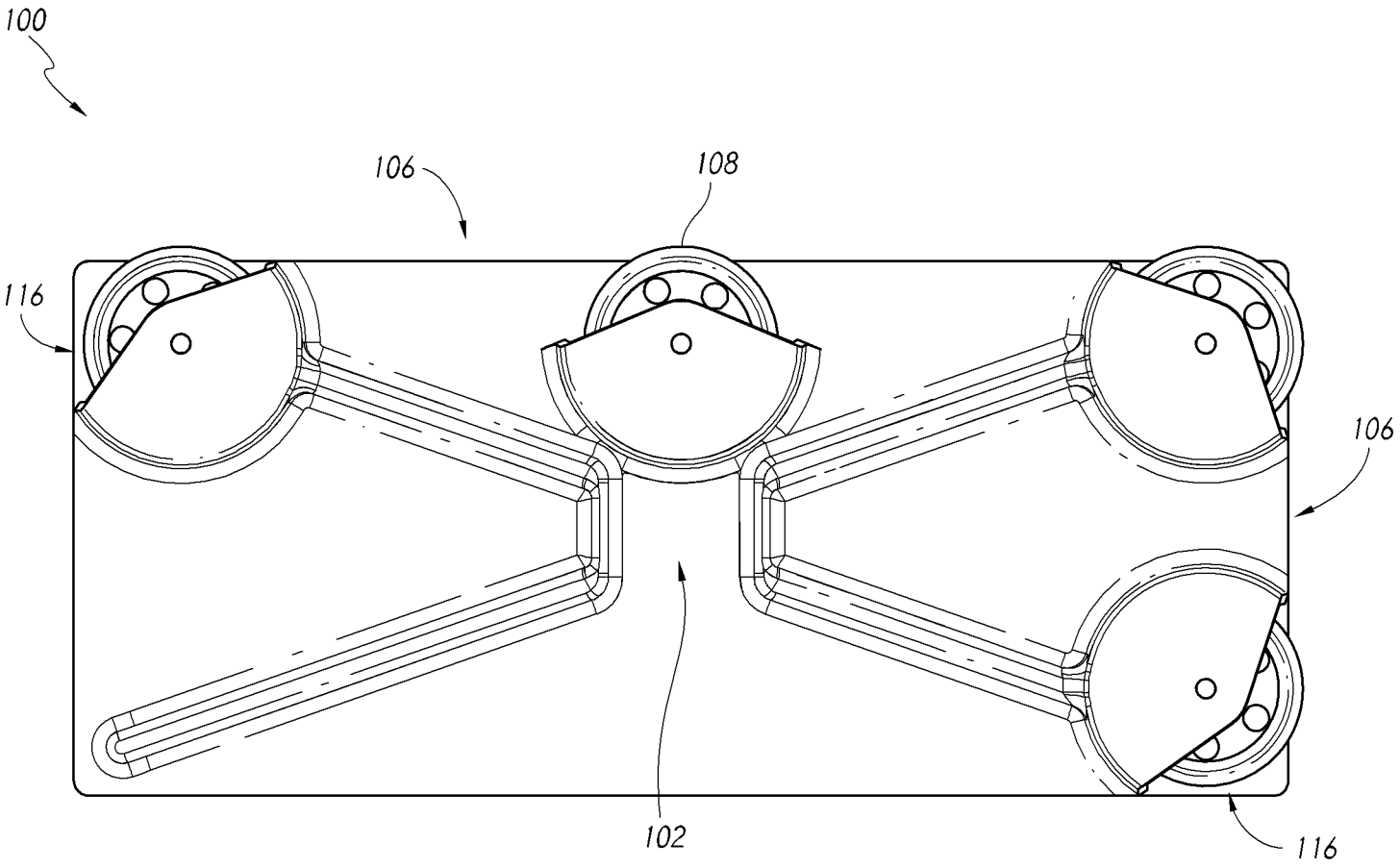
FIG. 9 shows a top view of the holder of FIGS. 8A and 8B.
Figure 12:
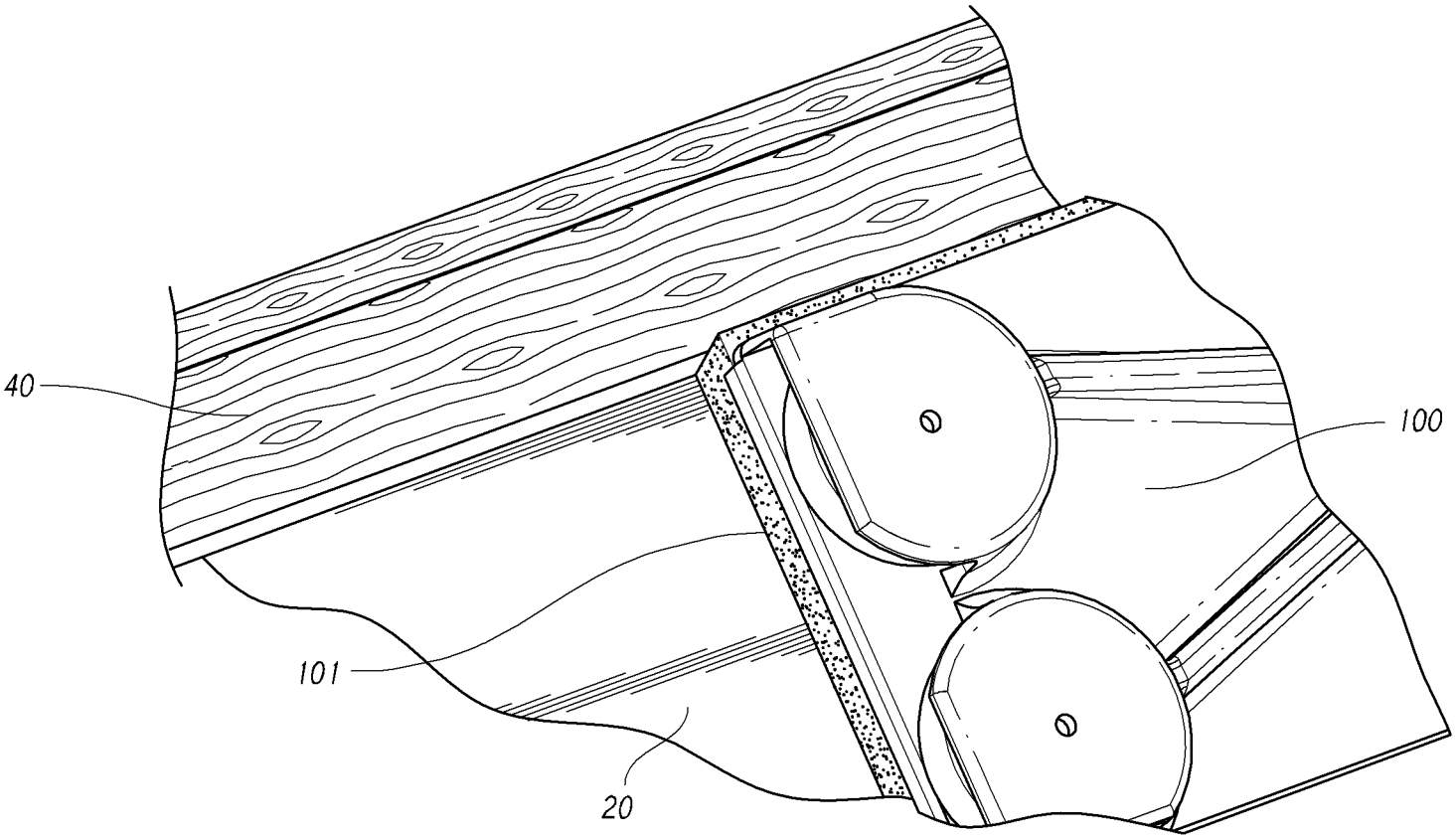
FIG. 12 shows the holder of FIG. 10 being used to clean a floor adjacent a baseboard.

With reference to FIG. 9, the wheels 108 extend beyond the edge of the base 100 on the sides including the lip 106, but are recessed from the edges of the base 100 on the sides of the base that do not include the lip 106, as indicated by gaps 116. Thus, two sides of the base 100 (the left and bottom sides in the orientation shown in FIG. 9) do not include features to inhibit the pad 101 from extending beyond the edges of the base 100 or to space the base 100 and/or pad 101 from the wall or another adjacent surface. This arrangement advantageously allows the pad 101 to extend beyond the edges of the base 100 on those two sides similar to the holders shown in FIGS. 1A and 1C for circumstances in which the user would like to clean the floor and adjacent surface simultaneously, for example, when the adjacent surface 40 is a baseboard or another surface made of the same material as the floor or a material that is durable enough to resist damage and marring from the pad 101, for example as illustrated in FIG. 12.

Although several embodiments and examples are disclosed herein, the present application extends beyond the specifically disclosed embodiments to other alternative embodiments and/or uses of the inventions and modifications and equivalents thereof. It is also contemplated that various combinations or subcombinations of the specific features and aspects of the embodiments may be made and still fall within the scope of the inventions. Accordingly, it should be understood that various features and aspects of the disclosed embodiments can be combine with or substituted for one another in order to form varying modes of the disclosed inventions. Thus, it is intended that the scope of the present inventions herein disclosed should not be limited by the particular disclosed embodiments described above, but should be determined only by a fair reading of the claims that follow.

What is claimed is:

1. A cleaning device for cleaning a surface, comprising:

a holder, wherein the holder comprises a base and at least one lip, the base comprising a top surface, a bottom surface and an outer periphery;

wherein the top surface of the base is configured to receive at least one handle;

wherein the bottom surface of the base is configured to receive a cleaning pad;

a lip extending downwardly from a perimeter of the base along at least one side of the base such that at least a portion of the lip extends below the bottom surface of the base, wherein the lip is at least partially adjacent at least one edge of the cleaning pad so as to prevent the at least one edge of the cleaning pad from extending outwardly beyond the lip, wherein the lip extends continuously along at least one side of the base; and at least one contacting member or feature extending from the base, the at least one contacting member or feature being sized and configured to extend outwardly beyond the periphery of the base.

2. The cleaning device of claim 1, wherein the lip extends along two adjacent sides of the base.

3. The cleaning device of claim 1, wherein the at least one contacting feature comprises at least one wheel or other movable member.

4. The cleaning device of claim 3, wherein the at least one wheel is disposed horizontally on the top surface of the base.

5. The cleaning device of claim 3, wherein a contacting portion of the at least one wheel comprises nitrile rubber.

6. The cleaning device of claim 3, the base further comprising at least one wheel housing configured to cover a portion of the at least one wheel.

7. The cleaning device of claim 1, wherein the at least one contacting feature comprises three contacting features positioned along the lip.

8. The cleaning device of claim 1, wherein the bottom surface of the base is configured to removably receive the cleaning pad.

9. The cleaning device of claim 1, wherein the lip comprises a smooth and flat surface.

10. The cleaning device of claim 1, wherein the base comprises a rectangular shape.

11. The cleaning device of claim 1, wherein the top surface of the base comprises a coupling for receiving a handle.

12. The cleaning device of claim 11, further comprising a handle configured for placement within the coupling.

13. The cleaning device of claim 12, wherein the handle is a pole handle.

14. The cleaning device of claim 12, wherein the handle is configured to handheld use.

15. The cleaning device of claim 1, wherein the contacting feature or member is separate from the base and is removably or permanently attached to the base.

16. The cleaning device of claim 1, wherein the lip extends along two adjacent sides of the base and the at least one contacting member comprises three contacting members, each of the three contacting members positioned proximate a corner of the base adjacent at least one of the sides including the lip.

17. The cleaning device of claim 16, wherein the three contacting members extend beyond the perimeter of the base on the two sides including the lip and are recessed from the perimeter of the base on sides of the base not including the lip.

18. The cleaning device of claim 16, further comprising a fourth contacting member positioned between two of the at least three contacting members along a side of the base including the lip.

19. A method of cleaning a first surface, comprising:

coupling a cleaning pad to a bottom surface of a holder, the holder comprising:

a base and at least one lip, the base comprising a top surface, the bottom surface and an outer periphery;

wherein the top surface of the base is configured to receive at least one handle;

wherein the bottom surface of the base is configured to receive the cleaning pad;

a lip extending downwardly from a perimeter of the base continuously laterally along at least one side of the base such that at least a portion of the lip extends below the bottom surface of the base, wherein the lip is at least partially adjacent at least one edge of the cleaning pad so as to prevent the at least one edge of the cleaning pad from extending outwardly beyond the lip; and at least one contacting member or feature extending from the base, the at least one contacting member or feature being sized and configured to extend outwardly beyond the periphery of the base;

positioning the holder such that the cleaning pad contacts the first surface and the at least one contacting member contacts a second surface, the second surface being adjacent the first surface; and cleaning the first surface.

20. The method of claim 19, further comprising positioning the holder such that the at least one contacting member is positioned away from the second surface, a bottom surface of the cleaning pad contacts the first surface, and an edge of the cleaning pad contacts the second, and cleaning the first surface.

* * * * *